US011666202B2

(12) United States Patent
Singhal

(10) Patent No.: US 11,666,202 B2
(45) Date of Patent: Jun. 6, 2023

(54) RACK MOUNTING FEATURES FOR A DISHWASHER APPLIANCE

(71) Applicant: Haier US Appliance Solutions, Inc., Wilmington, DE (US)

(72) Inventor: Arpit Singhal, Uttar Pradesh (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 117 days.

(21) Appl. No.: 17/108,427

(22) Filed: Dec. 1, 2020

(65) Prior Publication Data

US 2022/0167826 A1 Jun. 2, 2022

(51) Int. Cl.

| | |
|---|---|
| ***A47L 15/50*** | (2006.01) |
| ***A47L 15/42*** | (2006.01) |
| *A47L 15/22* | (2006.01) |

(52) U.S. Cl.

CPC ..... *A47L 15/50* (2013.01); *A47L 15/4246* (2013.01); *A47L 15/22* (2013.01)

(58) Field of Classification Search

CPC ..... A47L 15/22; A47L 15/50; A47L 15/4246
See application file for complete search history.

(56) References Cited

U.S. PATENT DOCUMENTS

| | | | | |
|---|---|---|---|---|
| 9,579,010 | B2 | 2/2017 | Shewmaker | |
| 9,833,123 | B2 * | 12/2017 | Shaffer | A47L 15/507 |
| 10,022,035 | B2 | 7/2018 | Dabade et al. | |
| 10,456,006 | B2 * | 10/2019 | Maddux | A47L 15/501 |
| 2015/0190033 | A1 * | 7/2015 | Shaffer | A47L 15/507 312/228.1 |
| 2016/0360946 | A1 * | 12/2016 | Shewmaker | A47L 15/507 |
| 2019/0365197 | A1 | 12/2019 | Maddux | |

* cited by examiner

*Primary Examiner* — James O Hansen
(74) *Attorney, Agent, or Firm* — Dority & Manning, P.A.

(57) ABSTRACT

A rack mounting assembly for supporting a third rack assembly within a tub of a dishwasher appliance is provided. The tub defines a wash chamber and a plurality of apertures spaced apart along a transverse direction. The rack mounting assembly includes a mounting body positioned inside the wash chamber and a latching arm positioned outside the wash chamber. The mounting body and/or latching arm include complementary features that pass through the plurality of apertures defined in the tub for engaging each other and securing the mounting body to the tub.

15 Claims, 6 Drawing Sheets

RACK MOUNTING FEATURES FOR A DISHWASHER APPLIANCE

FIELD OF THE INVENTION

The present disclosure relates generally to dishwasher appliances, and more particularly to improved rack mounting features for dishwasher appliances.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one pump for circulating fluid through the multiple spray assemblies. In addition, devices referred to as diverters may be used to control the flow of fluid received from the pump.

In addition to conventional lower and middle rack assemblies, certain dishwasher appliances include a "third rack" or "upper rack" positioned above the lower and middle rack assemblies, e.g., for receiving flatware, cutlery, or other cooking utensils. For both conventional and third rack assemblies, properly supporting such rack assemblies within the tub of the dishwasher appliance requires the installation of a mounting bracket or assembly. However, installing such mounting brackets is often complicated, requiring multiple parts and increasing the potential for misalignment or improper mounting. For example, assembly of such mounting brackets typically requires blind insertion of a mechanical fastener through a support plate and washer, through the tub, and into a boss defined on the mounting bracket.

Accordingly, a dishwasher appliance that utilizes improved rack mounting features would be useful. More specifically, a rack mounting assembly that enables a simple mounting of a third rack assembly with very few parts would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a dishwasher appliance defining a vertical, a lateral, and a transverse direction is provided. The dishwasher appliance include a tub defining a wash chamber for receipt of articles for washing, the tub defining a first aperture, a third rack assembly slidably positioned within the wash chamber and configured for movement along the transverse direction, and a rack mounting assembly for supporting the third rack assembly. The rack mounting assembly includes a mounting body positioned inside the wash chamber and defining a first mounting feature that extends through the first aperture defined in the tub and a latching arm positioned outside the wash chamber and defining a first locking feature for engaging the first mounting feature to secure the mounting body to the tub.

In another exemplary embodiment, a rack mounting assembly for supporting a third rack assembly within a tub of a dishwasher appliance is provided. The tub defines a wash chamber for receipt of articles for washing and a plurality of apertures. The rack mounting assembly includes a mounting body positioned inside the wash chamber and defining a first mounting feature that extends through a first aperture of the plurality of apertures defined in the tub and a latching arm positioned outside the wash chamber and defining a first locking feature for engaging the first mounting feature to secure the mounting body to the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
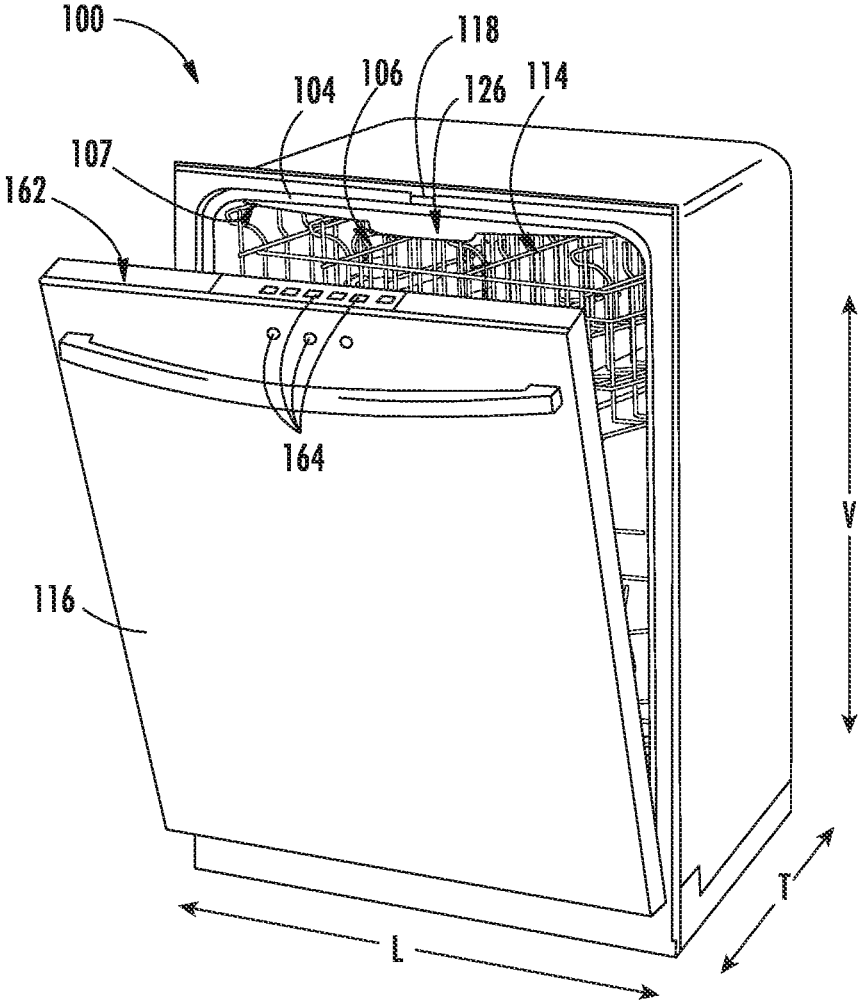
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments.

Figure 2:
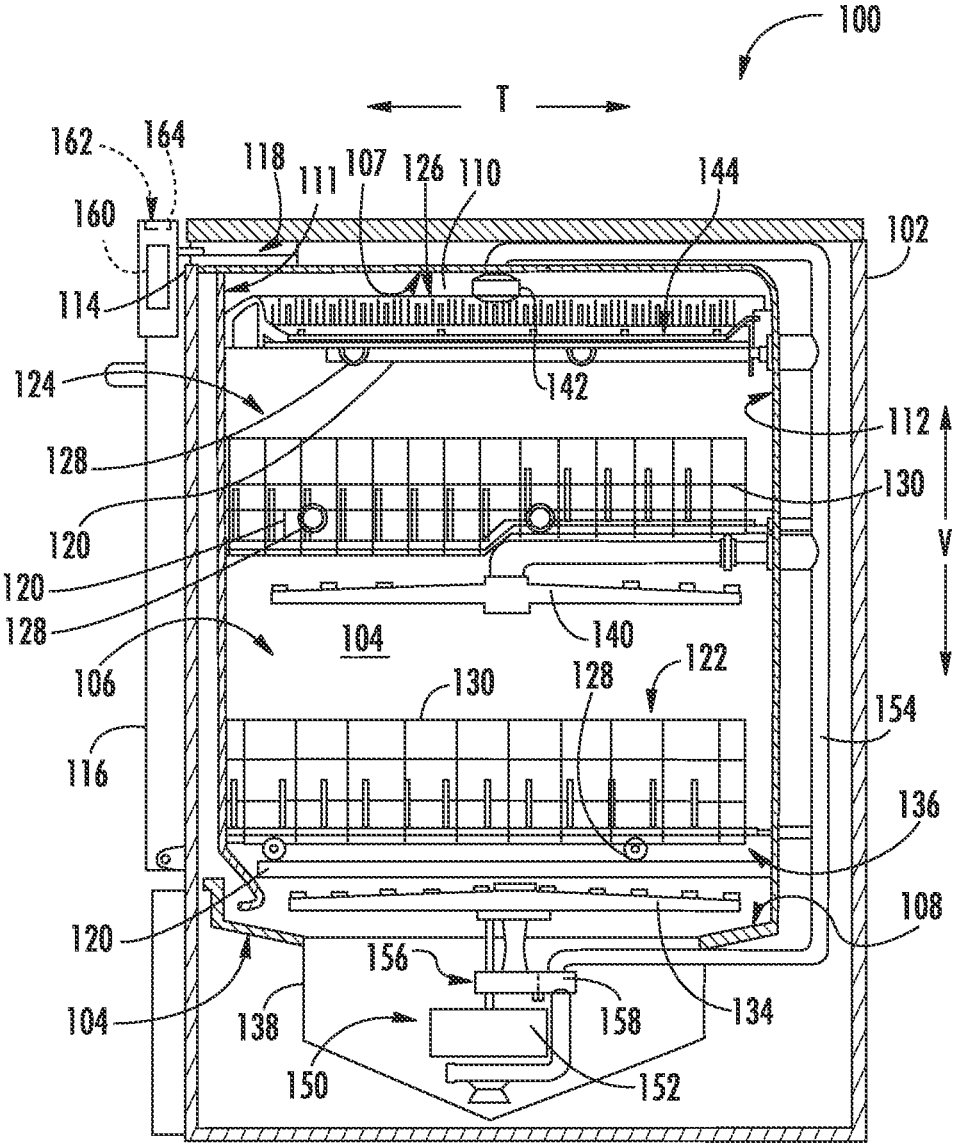
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and a third rack assembly 126. As illustrated, third rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, an upper spray assembly 142 may be located above third rack assembly 126 along the vertical direction V. In this manner, upper spray assembly 142 may be configured for urging and/or cascading a flow of wash fluid downward over rack assemblies 122, 124, and 126. As further illustrated in FIG. 2, third rack assembly 126 may further define an integral spray manifold 144, which is generally configured for urging a flow of wash fluid substantially upward along the vertical direction V through third rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, i.e., such as primary supply conduit 154.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
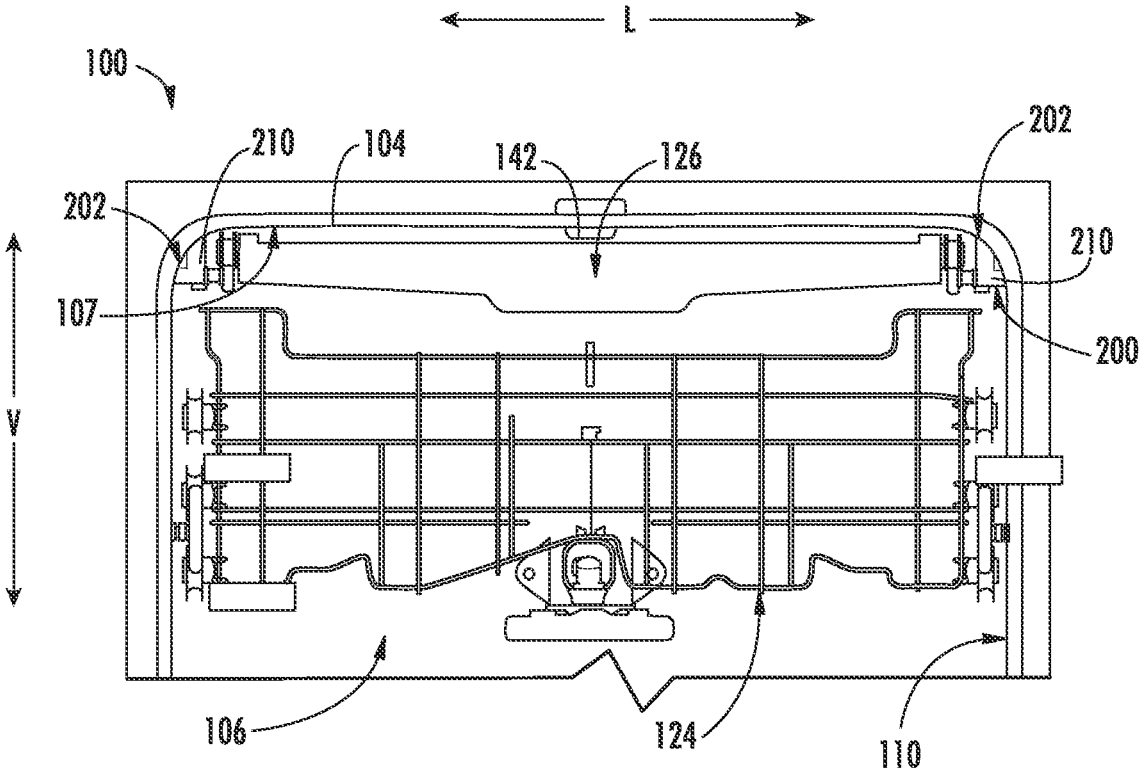
FIG. 3 provides a front view of a third rack assembly of the exemplary dishwashing appliance of FIG. 1 according to an exemplary embodiment of the present subject matter.
Figure 4:
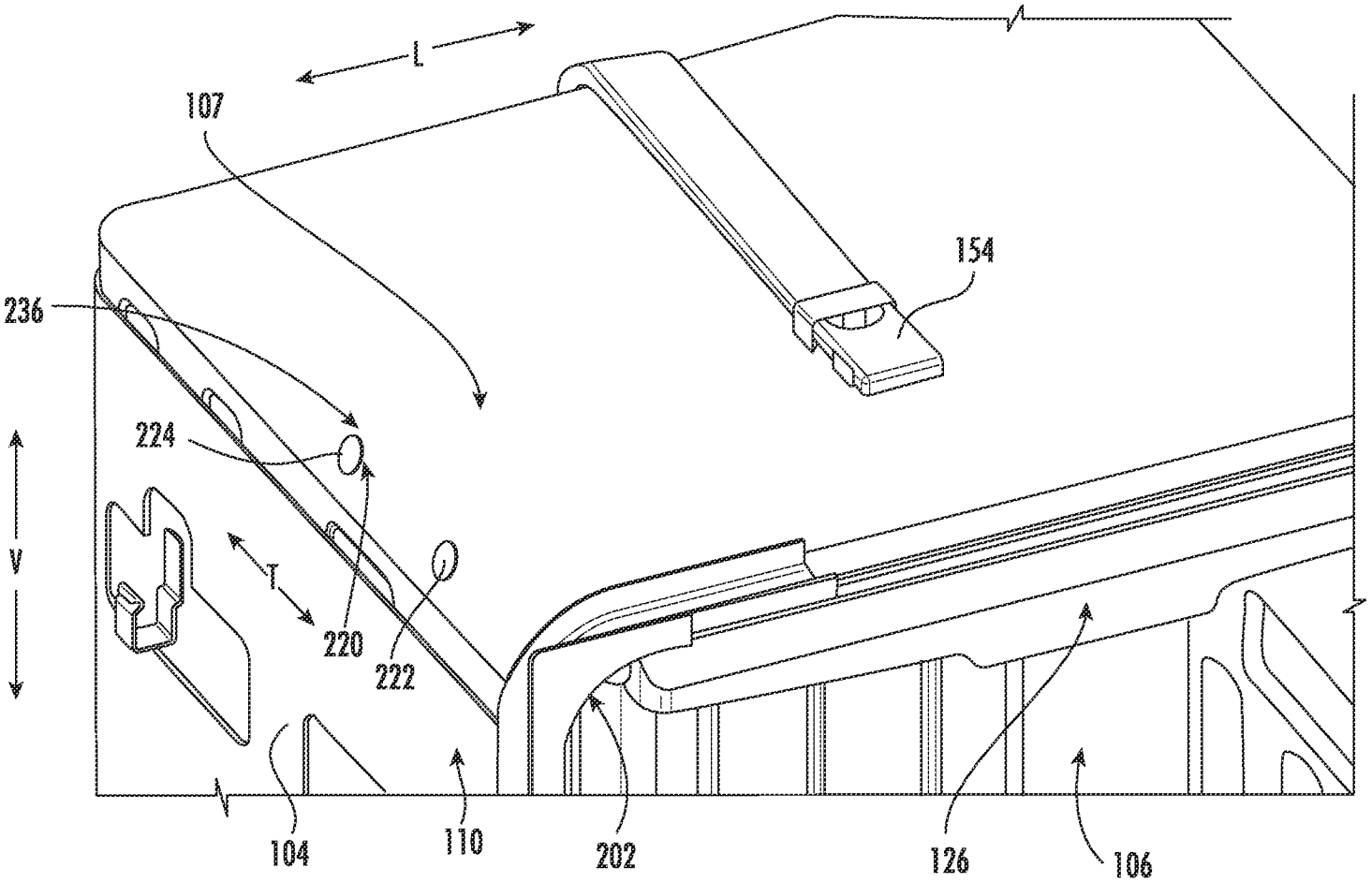
FIG. 4 provides a perspective view of the exemplary dishwashing appliance of FIG. 1 with a portion of a cabinet removed to reveal a tub according to an example embodiment of the present subject matter.

Referring now generally to FIGS. 2 and 3, a rack mounting assembly 200 for mounting third rack assembly 126 to tub 104 will be described according to an exemplary embodiment of the present subject matter. According to the illustrated embodiment, dishwasher appliance 100 includes two rack mounting assemblies 200 positioned within wash chamber 106 and mounted to tub 104 for supporting third rack assembly 126. However, it should be appreciated that aspects of the present subject matter may be used to support any suitable rack assembly in any suitable appliance. For example, mounting assemblies 200 or aspects thereof may be used to support lower rack assembly 122, middle rack assembly 124, or a rack of any other suitable appliance, such as a refrigerator or oven appliance. According to exemplary embodiments of the present subject matter, the two rack mounting assemblies include only two pieces and are identical and interchangeable.

As best illustrated in FIG. 3, dishwasher appliance 100 includes two rack mounting assemblies 200 positioned at the top corners of tub 104. More specifically, tub 104 defines radiused corners 202 where top wall 107 and the left and right side walls 110 meet. Radiused corners 202 are frequently used in dishwasher appliance tubs to simplify the formation process and improve the structural rigidity of tub 104. However, installing rack mounting assemblies 200 within such radiused corners 202 is often a difficult task. For example, space is limited within tub 104 and technicians often have to insert screws into blind holes. According to exemplary embodiments of the present subject matter, tub 104 is formed from stainless steel or any other suitably rigid material. According to still other embodiments, tub 104 may be injection-molded using any suitable plastic material.

Referring now also to FIGS. 4 through 7, rack mounting assembly 200 will be generally described according to an exemplary embodiment. As illustrated, rack mounting assembly 200 generally includes a mounting body 210 that is positioned inside wash chamber 106 and a latching arm 212 that is positioned outside of wash chamber 106. As explained in more detail below, mounting body 210 and latching arm 212 include complementary features that are designed to engage each other such that mounting body 210 and latching arm 212 sandwich or clamp onto tub 104 when connected. In this regard, rack mounting assembly 200 is a two-piece assembly that is quick and easy for a technician to install onto tub 104.

In order to permit interaction between the mounting body 210 and latching arm 212, tub 104 defines a plurality of apertures 220 through which a portion of mounting body 210 and/or latching arm 212 may pass to engage each other. Specifically, according to the illustrated embodiment, tub 104 defines a first aperture 222 and a second aperture 224 that are spaced apart along the transverse direction T. According to exemplary embodiments, first aperture 222 and second aperture 224 are sized just large enough to receive the mounting features of mounting body 210 and latching arm 212 without introducing a large leak point. In addition, first aperture 222 and second aperture 224 may have a resilient sealing element (not shown), such as a gasket or O-ring, mounted therein to provide a fluid tight engagement with mounting body 210 and/or latching arm 212. Although two apertures 220 are illustrated for purposes of explaining aspects of the present subject matter, it should be appreciated that the number, size, position, and configuration of apertures 220 may vary while remaining within the scope of the present subject matter.

Figure 5:
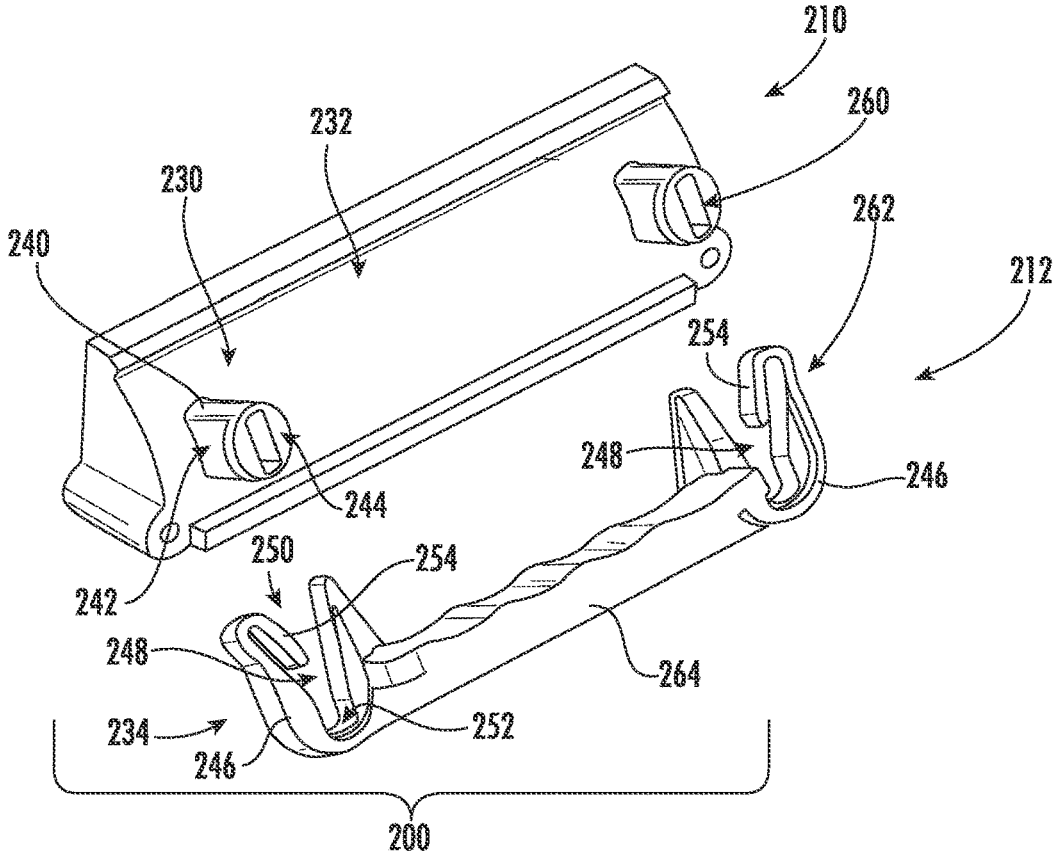
FIG. 5 provides a perspective view of an exemplary rack mounting assembly according to an exemplary embodiment of the present subject matter.
Figure 6:
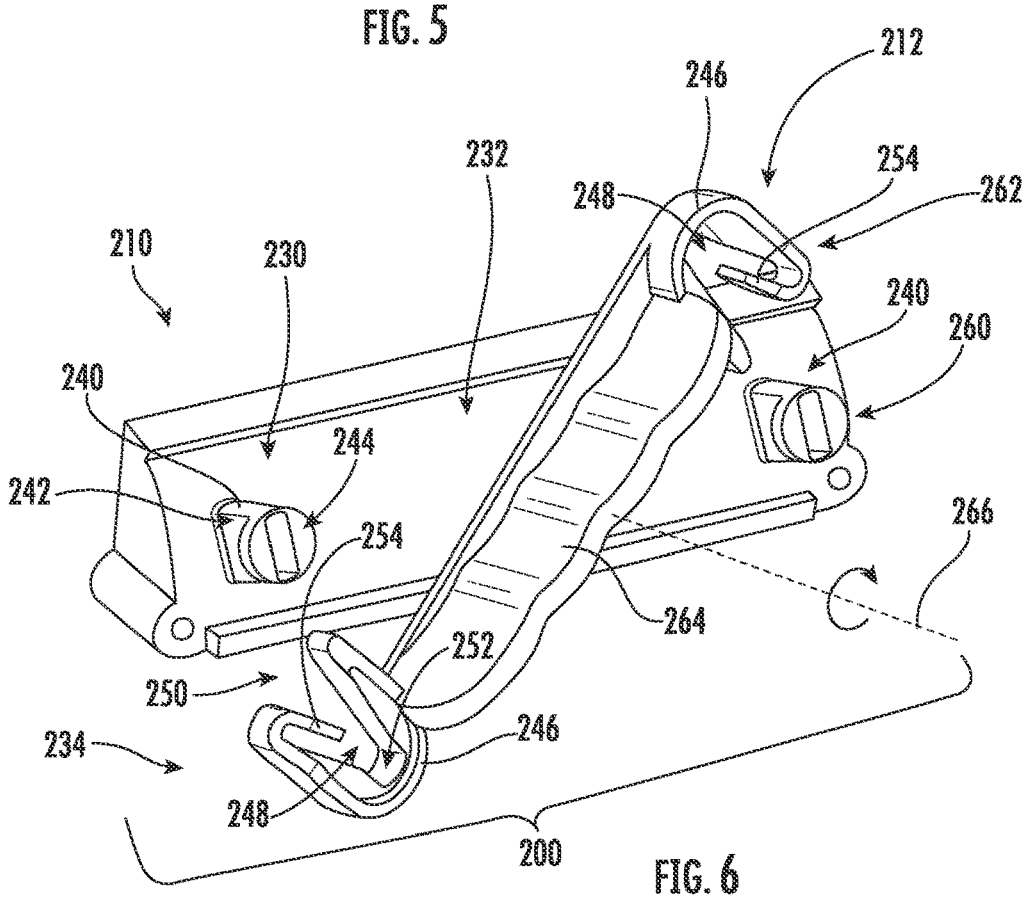
FIG. 6 provides a perspective view of another exemplary rack mounting assembly according to an exemplary embodiment of the present subject matter.
Figure 7:
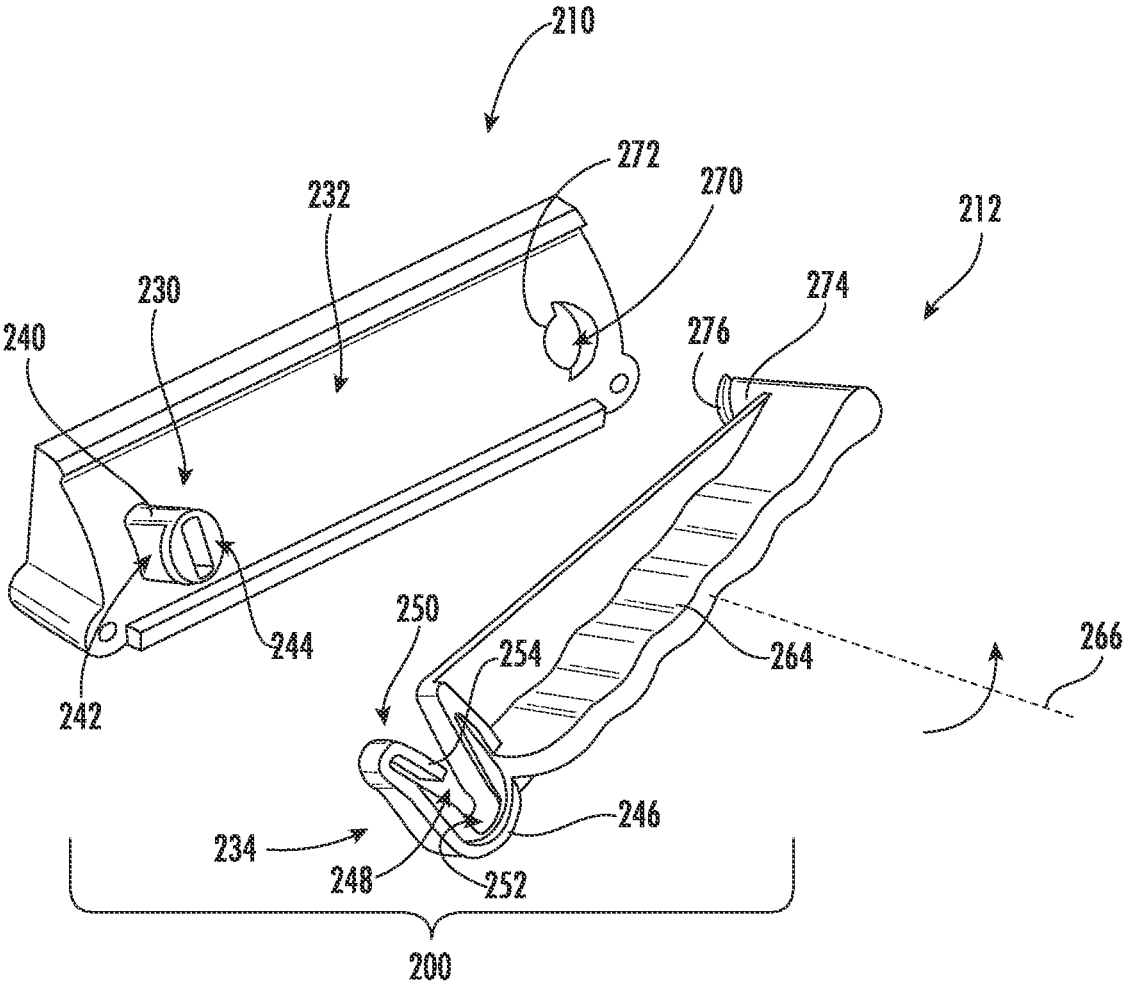
FIG. 7 provides a perspective view of another exemplary rack mounting assembly according to an exemplary embodiment of the present subject matter.

Referring now specifically to FIGS. 5 through 7, mounting body 210 may include or define a first mounting feature 230 that extends away from a rear surface 232 of mounting body 210. Thus, when mounting body 210 is positioned on or installed within tub 104, first mounting feature 230 may extend through first aperture 222, e.g., such that is positioned outside of tub 104 and may be engaged by latching arm 212. More specifically, latching arm 212 may define a first locking feature 234 that is generally configured for engaging the first mounting feature 230 to secure mounting body 210 to tub 104. When first locking feature 234 engages first mounting feature 230, mounting body 210 and latching arm 212 are securely joined and snuggly pressed against tub 104, e.g., such that latching arm 212 is securely seated against an outer surface 236 of tub 104. Although exemplary mounting features and locking features are described herein in order to explain aspects of the present subject matter, it should be appreciated that any mechanically interacting or complementary features for securing mounting body 210 and latching arm 212 together may be used while remaining within the scope of the present subject matter.

According to exemplary embodiments of the present subject matter, first mounting feature 230 is a cylindrical post 240 that defines a flattened portion 242 that is positioned between rear surface 232 of mounting body 210 and a locking flange 244 that is positioned on a distal end of cylindrical post 240. In addition, first locking feature 234 generally includes a locking clip 246 that defines a notch 248 for securely receiving cylindrical post 240. More specifically, notch 248 includes an opening 250 for receiving cylindrical post 240 and a base 252 where cylindrical post 240 bottoms out within notch 248. In this regard, once a cylindrical post 240 is inserted through first aperture 222, locking clip 246 may be moved toward cylindrical post 240 such that flattened portion 242 slides through opening 250 into notch 248 before stopping against base 252.

In addition, locking clip 246 may include one or more resilient elements 254 that are generally positioned and configured for securing cylindrical post 240 within notch 248, e.g., securely seating cylindrical post 240 against base 252 such that it may not be removed from notch 248. Specifically, according to the illustrated embodiment, resilient element 254 is mounted on locking clip 246 proximate opening 250 and extends toward base 252. In this manner, as cylindrical post 240 slides into notch 248, resilient element 254 is deflected until a cylindrical post 240 clears resilient element 254, at which point resilient element 254 snaps back into place and secures cylindrical post 240.

Referring now to FIG. 5, mounting body 210 may include a second mounting feature 260 and latching arm 212 may include a second locking feature 262 that engage each other to secure mounting body 210 and latching arm 212 at a different location. Specifically, according to the illustrated embodiment, second mounting feature 260 is similar or identical to the first mounting feature 230 and second locking feature 262 is similar or identical to the first locking feature 234. In this regard, second mounting feature 260 is a cylindrical post 240 that are spaced apart from the first mounting feature 230 (i.e., another cylindrical post 240) and second locking feature 262 is a locking clip 246 spaced apart from first locking feature 234 (i.e., another locking clip 246). Specifically, for example, latching arm 212 may include locking clips 246 positioned at both ends of a handle portion 264.

Notably, to install rack mounting assembly 200 as shown in FIG. 5, mounting body 210 is positioned against tub 104 such that first mounting feature 230 and second mounting feature 260 pass through first aperture 222 and second aperture 224, respectively. While holding mounting body 210 in place, latching arm 212 may be positioned such that mounting features 230, 260 are engaged by locking features 234, 262. For example, according to an exemplary embodiment, such as shown in FIG. 5, latching arm 212 may be secured to the mounting body 210 by sliding or translating latching arm 212 along outer surface 236 of tub 104. Thus, according to this embodiment, notches 248 of first locking feature 234 and second locking feature 262 are oriented in the same direction. By contrast, referring briefly to FIG. 6, notches 248 could instead be oriented in opposite directions, such that a user installs latching arm 212 by rotating latching arm 212 about a central axis 266.

Referring now to FIG. 7, according to an exemplary embodiment of the present subject matter, mounting body 210 may include a receiving hole 270 that has an entrance at least partially covered by a keyed entry flange 272. In this regard, keyed entry flange 272 is positioned at or forma a part of rear surface 232 of mounting body 210. In addition, latching arm 212 may define an insertion arm 274 that includes a keyed distal end 276. Notably, keyed entry flange 272 and keyed distal end 276 are designed to be complementary such that keyed entry flange 272 engages keyed distal end 276 to prevent entry of insertion arm 274 into receiving hole 270 unless latching arm 212 is oriented at a first angular position relative to mounting body 210. In this regard, as shown for example in FIG. 7, latching arm 212 and mounting body 210 must be oriented end-to-end, e.g., such that insertion arm 274 is positioned between locking clip 246 and first mounting feature 230 along the transverse direction T, before insertion arm 274 may be received within the receiving hole 270.

After insertion arm 274 is fully received within the receiving hole 270, latching arm 212 may be rotated such that keyed entry flange 272 and keyed distal end 276 engage each other to lock insertion arm 274 within the receiving hole 270. According to the illustrated embodiment, first mounting feature 230 engages first locking feature 234 when latching arm 212 continues to rotate into a second angular position. Specifically, according to the illustrated embodiment, moving latching arm 212 from the first angular position to the second angular position includes rotating the latching arm by 180° about central axis 266.

Notably, the embodiments of rack mounting assembly 200 illustrated in FIGS. 5 through 7 use different complementary features to secure latching arm 212 and mounting body 210 to tub 104. It should be appreciated that these features may be interchangeable while remaining within the scope of the present subject matter. In addition, it should be appreciated that variations and modifications may be made to such mounting structures without departing from the scope of the present subject matter.

It should be appreciated that rack mounting assembly 200 is described herein only for the purpose of explaining aspects of the present subject matter. Modifications and variations may be made to rack mounting assembly 200 while remaining within the scope of the present subject matter. For example, the size, configuration, position, and operation of mounting body 210 and latching arm 212 may vary or be adjusted to control the interaction with tub 104 or each other while remaining within the scope of the present subject matter. Rack mounting assembly 200 as described above provides a simple and effective mechanism for installing third rack assembly 126 or any other suitable rack assembly within dishwasher appliance 100 in a reliable manner and with only two pieces. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a tub defining a wash chamber for receipt of articles for washing, the tub defining a first aperture;

a third rack assembly slidably positioned within the wash chamber and configured for movement along the transverse direction; and a rack mounting assembly for supporting the third rack assembly, the rack mounting assembly comprising:

a mounting body positioned inside the wash chamber and defining a first mounting feature that extends through the first aperture defined in the tub; and a latching arm positioned outside the wash chamber and defining a first locking feature for engaging the first mounting feature to secure the mounting body to the tub, wherein the first locking feature comprises a locking clip defining a notch with an opening for receiving the first mounting feature and a base where the first mounting feature bottoms out in the notch and one or more resilient elements securing the first mounting feature in the notch, wherein the one or more resilient elements are mounted on the locking clip proximate the opening and extend toward the base.

2. The dishwasher appliance of claim 1, wherein the first mounting feature is a cylindrical post defining a flattened portion for engaging the locking clip.

3. The dishwasher appliance of claim 1, wherein the tub further defines a second aperture, the second aperture being spaced apart from the first aperture along the transverse direction.

4. The dishwasher appliance of claim 3, wherein the mounting body further defines a second mounting feature that extends through the second aperture defined in the tub, and the latching arm defines a second locking feature for engaging the second mounting feature.

5. The dishwasher appliance of claim 4, wherein the first mounting feature engages the first locking feature and the second mounting feature engages the second locking feature when the latching arm slides along an outer surface of the tub.

6. The dishwasher appliance of claim 4, wherein the first mounting feature engages the first locking feature and the second mounting feature engages the second locking feature when the latching arm is rotated about a central axis.

7. The dishwasher appliance of claim 3, wherein the mounting body further defines a receiving hole defining a keyed entry flange, the latching arm defines an insertion arm with a keyed distal end, and wherein the keyed entry flange engages the keyed distal end to prevent entry of the insertion arm into the receiving hole unless the latching arm is oriented at a first angular position relative to the mounting body.

8. The dishwasher appliance of claim 7, wherein rotating the latching arm from the first angular position to a second angular position after the insertion arm is positioned through the second aperture and is in the receiving hole locks the latching arm to the mounting body and prevents removal of the insertion arm from the receiving hole.

9. The dishwasher appliance of claim 8, wherein the first mounting feature engages the first locking feature when the latching arm is in the second angular position.

10. The dishwasher appliance of claim 8, wherein moving the latching arm from the first angular position to the second angular position comprises rotating the latching arm by 180 degrees about a central axis.

11. The dishwasher appliance of claim 1, wherein the the rack mounting assembly is a first rack mounting assembly positioned proximate a first side wall of the dishwasher appliance, wherein the dishwasher further comprises a second rack mounting assembly positioned proximate a second side wall of the dishwasher appliance, and wherein the first rack mounting assembly and the second rack mounting assembly are identical and interchangeable.

12. The dishwasher appliance of claim 1, wherein the tub is made of stainless steel.

13. A rack mounting assembly for supporting a third rack assembly within a tub of a dishwasher appliance, the tub defining a wash chamber for receipt of articles for washing and a plurality of apertures, the rack mounting assembly comprising:

a mounting body positioned inside the wash chamber and defining a first mounting feature that extends through a first aperture of the plurality of apertures defined in the tub; and a latching arm positioned outside the wash chamber and defining a first locking feature for engaging the first mounting feature to secure the mounting body to the tub, wherein the tub further defines a second aperture, the second aperture being spaced apart from the first aperture along the transverse direction, wherein the mounting body further defines a second mounting feature that extends through the second aperture defined in the tub, and the latching arm defines a second locking feature for engaging the second mounting feature, and wherein the first mounting feature engages the first locking feature and the second mounting feature engages the second locking feature when the latching arm is rotated about a central axis.

14. The rack mounting assembly of claim 13, wherein the first locking feature comprises:

a locking clip defining a notch with an opening for receiving the first mounting feature and a base where the first mounting feature bottoms out in the notch; and one or more resilient elements securing the first mounting feature in the notch.

15. The rack mounting assembly of claim 14, wherein the first mounting feature is a cylindrical post defining a flattened portion for engaging the locking clip, and wherein the one or more resilient elements are mounted on the locking clip proximate the opening and extend toward the base.

* * * * *